US009809419B2

(12) United States Patent
Otsuka et al.

(10) Patent No.: US 9,809,419 B2
(45) Date of Patent: Nov. 7, 2017

(54) ELEVATOR APPARATUS

(71) Applicant: MITSUBISHI ELECTRIC CORPORATION, Chiyoda-ku (JP)

(72) Inventors: Yasushi Otsuka, Chiyoda-ku (JP); Takuo Kugiya, Chiyoda-ku (JP)

(73) Assignee: MITSUBISHI ELECTRIC CORPORATION, Chiyoda-ku (JP)

( * ) Notice: Subject to any disclaimer, the term of this patent is extended or adjusted under 35 U.S.C. 154(b) by 356 days.

(21) Appl. No.: 14/761,533

(22) PCT Filed: Nov. 13, 2013

(86) PCT No.: PCT/JP2013/080674

§ 371 (c)(1),
(2) Date: Jul. 16, 2015

(87) PCT Pub. No.: WO2014/115402

PCT Pub. Date: Jul. 31, 2014

(65) Prior Publication Data

US 2015/0336768 A1 Nov. 26, 2015

(30) Foreign Application Priority Data

Jan. 23, 2013 (JP) ..... 2013-010302

(51) Int. Cl.
*B66B 1/34* (2006.01)
*B66B 1/36* (2006.01)

(52) U.S. Cl.
CPC ..... *B66B 1/3492* (2013.01); *B66B 1/36* (2013.01)

(58) Field of Classification Search
CPC ..... B66B 1/3492; B66B 1/36
(Continued)

(56) References Cited

U.S. PATENT DOCUMENTS 7,441,631 B2 * 10/2008 Oh ..... B66B 1/3492 187/291
7,493,991 B2 * 2/2009 Oh ..... B66B 1/3492 187/247

(Continued)

FOREIGN PATENT DOCUMENTS

EP 2 380 841 A1 10/2011
JP 2006-256795 A 9/2006

(Continued)

OTHER PUBLICATIONS

International Search Report dated Feb. 18, 2014 in PCT/JP13/080674 Filed Nov. 13, 2013.

*Primary Examiner* — Anthony Salata
(74) *Attorney, Agent, or Firm* — Oblon, McClelland, Maier & Neustadt, L.L.P.

(57) ABSTRACT

In an elevator apparatus, a plurality of storage media are arranged in a hoistway so as to be spaced from one another in a hoisting direction of a car. In the car, reading device that reads information stored in the storage media is mounted. The storage media are arranged in the hoisting direction at intervals different from one another. A safety monitor is configured to: execute an operation for detecting two storage media; measure an interval between the detected storage media based on a signal from movement detector; compare the measured interval between the storage media with stored intervals of the storage media: and to grasp the position of the car by using a result of the comparison and the information of the storage media, when a position of the car cannot be grasped.

14 Claims, 9 Drawing Sheets

(58) Field of Classification Search
USPC ..... 187/247, 391–394, 397–399; 340/547, 340/551
See application file for complete search history.

(56) References Cited

U.S. PATENT DOCUMENTS

| | | | | |
|---|---|---|---|---|
| 7,533,763 | B2 * | 5/2009 | Kattainen | B66B 1/28 187/287 |
| 7,562,747 | B2 * | 7/2009 | Marchesi | B66B 1/3492 187/291 |
| 7,600,613 | B2 * | 10/2009 | Kang | B66B 1/3492 187/283 |
| 7,699,143 | B2 * | 4/2010 | Tschuemperlin | B66B 1/34 187/394 |
| 8,123,003 | B2 * | 2/2012 | Meri | B66B 1/3492 187/247 |
| 8,307,953 | B2 * | 11/2012 | Ferreira | B66B 1/3492 187/247 |
| 8,408,364 | B2 * | 4/2013 | Kangas | B66B 1/3492 187/247 |
| 9,580,273 | B2 * | 2/2017 | Kattainen | B65G 43/06 |
| 9,676,591 | B2 * | 6/2017 | Banno | B66B 5/06 |
| 9,701,514 | B2 * | 7/2017 | Kangas | B66B 3/02 |
| 2010/0155182 | A1 | 6/2010 | Ueda et al. | |

FOREIGN PATENT DOCUMENTS

| | | | |
|---|---|---|---|
| JP | 2006-273541 | A | 10/2006 |
| JP | 2011-102163 | A | 5/2011 |
| WO | 2008/062500 | A1 | 5/2008 |
| WO | 2010/084581 | A | 7/2010 |

* cited by examiner

ELEVATOR APPARATUS

TECHNICAL FIELD

The present invention relates to an elevator apparatus, which includes a plurality of storage media installed in a hoistway, for detecting a position of a car.

BACKGROUND ART

In a related-art elevator apparatus, a plurality of shielding plates each corresponding to a door zone are installed in a hoistway. An RFID that stores information on a car position is attached to each shielding plate. In a car, a car position detector including a shielding plate detection portion and an RFID communication portion is mounted.

When the car position cannot be grasped, for example, when the car makes an emergency stop due to a power cut, a restoring operation for driving the car at low speed to determine the car position is carried out. During the restoring operation, the information stored in the RFID is read to obtain the car position information. In this case, the car position can be determined only by reading information of one RFID, and thus normal services are quickly restored (see, e.g., Patent Literature 1).

CITATION LIST

Patent Literature

[PTL 1] JP 2011-102163 A

SUMMARY OF INVENTION

Technical Problem

In the related-art elevator apparatus described above, if equipment used for detecting the car position is in a failed state during the restoring operation, erroneous car position information may be obtained. Therefore, the obtained car position information is not reliable enough, thereby being difficult to apply a car position detection technology using the RFID to safety monitoring.

The present invention has been made to solve the problem described above, and therefore has an object to provide an elevator apparatus capable of carrying out, when a car position cannot be grasped, highly reliable car position detection by using a storage medium installed in a hoistway, thereby being applicable to safety monitoring.

Solution to Problem

According to one embodiment of the present invention, there is provided an elevator apparatus, including: a car; movement detector that generates a signal in accordance with movement of the car; a plurality of storage media arranged in a hoistway so as to be spaced from one another in a hoisting direction of the car; reading device mounted to the car, that reads information stored in the plurality of storage media; and a safety monitor that detects a moving amount and a position of the car by using the signal from the movement detector and monitoring presence or absence of abnormality in an operation state of the car. In the elevator apparatus, the plurality of storage media are arranged in the hoisting direction of the car at intervals different from one another. The safety monitor is configured to store the intervals of the plurality of storage media. The safety monitor is configured to: execute an operation for detecting two of the plurality of storage media; measure an interval between the detected two of the plurality of storage media based on the signal from the movement detector; compare the measured interval between the two of the plurality of storage media with the stored intervals of the plurality of storage media; and to grasp the position of the car by using a result of the comparison and the information of the plurality of storage media, when the position of the car is unable to be grasped.

Further, according to one embodiment of the present invention, there is provided an elevator apparatus, including: a car; movement detector that generates a signal in accordance with movement of the car; a plurality of storage media arranged in a hoistway so as to be spaced from one another in a hoisting direction of the car; reading device mounted to the car, that reads information stored in the plurality of storage media; a plurality of members to be detected, which are arranged in the hoistway so as to be spaced from one another in the hoisting direction of the car; a position sensor mounted to the car, that detects the plurality of members to be detected; and a safety monitor that detects a moving amount and a position of the car by using the signal from the movement detector and monitoring presence or absence of abnormality in an operation state of the car. In the elevator apparatus, the safety monitor is configured to store a distance from a detection position of the storage medium to a detection position of the member to be detected adjacent thereto and position information of the plurality of members to be detected. The safety monitor is configured to: execute an operation for detecting the storage medium and the member to be detected; measure a distance from the detection position of the storage medium to the detection position of the member to be detected based on the signal from the movement detector; compare the measured distance with the stored information; and to grasp the position of the car by using a result of the comparison, the information of the plurality of storage media, and the position information of the plurality of members to be detected, when the position of the car is unable to be grasped.

Advantageous Effects of Invention

In the elevator apparatus according to the one embodiment of the present invention, the storage media are arranged in the hoisting direction of the car at the intervals different from one another. The safety monitor is configured to store the intervals of the storage media. The safety monitor is configured to: execute the operation for detecting the two storage media; measure the interval between the detected storage media based on the signal from the movement detector; compare the measured interval between the storage media with the stored intervals of the storage media; and to grasp the position of the car by using the result of the comparison and the information of the storage media, when the position of the car cannot be grasped. Therefore, when the position of the car cannot be grasped, highly reliable car position detection applicable even to safety monitoring can be carried out by using the storage media.

Further, in the elevator apparatus according to the present invention, the safety monitor is configured to: store the distance from the detection position of the storage medium to the detection position of the member to be detected adjacent thereto and the position information of the members to be detected; execute, when the position of the car cannot be grasped, the operation for detecting the storage media and the members to be detected; measure the distance from the detection position of the storage medium to the detection position of the member to be detected based on the signal from the movement detector; compare the measured distance with the stored information; and to grasp the position of the car by using the result of the comparison, the information of the storage media, and the position information of the members to be detected. Therefore, when the position of the car cannot be grasped, by using the storage media, highly reliable car position detection also usable for safety monitoring can be carried out.

DESCRIPTION OF EMBODIMENTS

Figure 1:
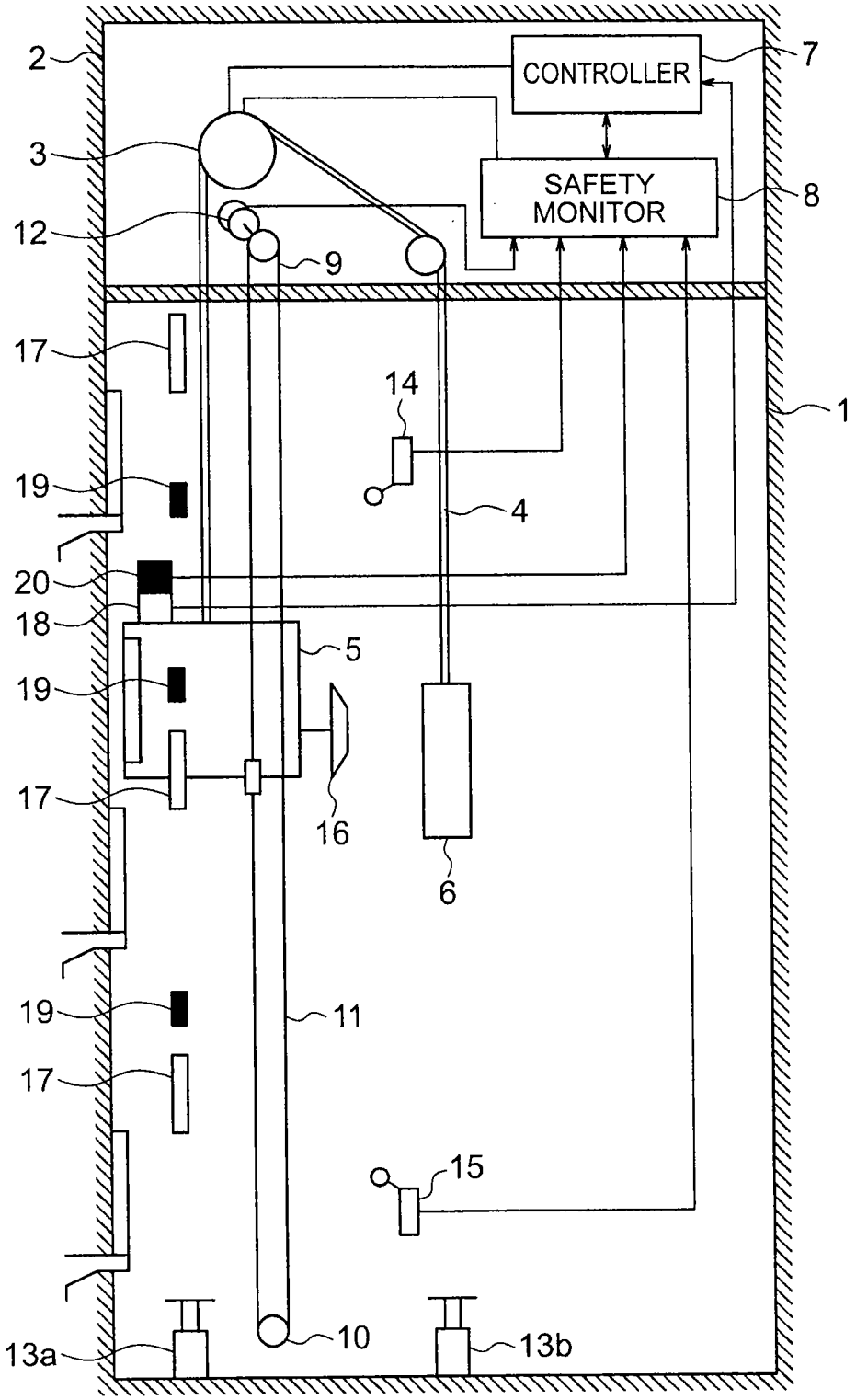
FIG. 1 is a configuration diagram showing an elevator apparatus according to a first embodiment of the present invention.

Now, embodiments of the present invention are described referring to the drawings.

First Embodiment

FIG. 1 is a configuration diagram showing an elevator apparatus according to a first embodiment of the present invention. In FIG. 1, in an upper portion of a hoistway 1, a machine room 2 is provided. In the machine room 2, a hoisting machine 3 is installed. The hoisting machine 3 includes a driving sheave, a hoisting-machine motor for rotating the driving sheave, and a hoisting-machine brake for braking the rotation of the driving sheave.

A suspension body 4 is looped around the driving sheave. As the suspension body 4, a plurality of ropes or a plurality of belts are used.

A car 5 and a counterweight 6 are suspended by the suspension body 4 inside the hoistway 1, and are raised and lowered by the hoisting machine 3 inside the hoistway 1. Inside the hoistway 1, a pair of car guide rails (not shown) for guiding the raising and lowering of the car 5 and a pair of counterweight guide rails (not shown) for guiding the raising and lowering of the counterweight 6 are installed.

In the machine room 2, an elevator controller 7 and a safety monitor (electronic safety monitor) 8 are installed. The elevator controller 7 carries out operation management of the car 5, control of a power source, and the like. The safety monitor 8 monitors the presence or absence of abnormality in the entire elevator apparatus including an operation state of the car 5.

The elevator controller 7 and the safety monitor 8 respectively include independent computers. This enables the safety monitor 8 to monitor a state of the elevator apparatus independently of the elevator controller 7. The elevator controller 7 and the safety monitor 8 can communicate with each other in two ways.

A speed governor 9 is installed in the machine room 2. The speed governor 9 includes a speed governor sheave. A looped speed governor rope 11 is wound around the speed governor sheave. A tension sheave 10 is installed in a lower part of the hoistway 1. A lower end of the speed governor rope 11 is wound around the tension sheave 10.

The speed governor rope 11 is connected to the car 5, and circulated along with hoisting of the car 5. The speed governor sheave is accordingly rotated at a speed corresponding to a traveling speed of the car 5. Two speed governor encoders (rotary encoders) 12, which are rotation detectors for detecting a rotational amount of the speed governor sheave, are arranged coaxially on the speed governor sheave. The two speed governor encoders 12 are used herein, but three or more speed governor encoders 12 may be used.

The speed governor encoder 12 outputs, as a movement detector, a pulse signal in accordance with movement of the car 5. The pulse signal output from the speed governor encoder 12 is input to the safety monitor 8. The safety monitor 8 executes calculation processing for the pulse signal from the speed governor encoder 12 to convert the pulse signal into a moving amount of the car 5.

In a pit of the hoistway 1, a car shock absorber 13*a* for absorbing an impact of the car 5 to a hoistway bottom part and a counterweight shock absorber 13*b* for absorbing an impact of the counterweight 6 to the hoistway bottom part are installed.

Near an upper terminal floor in the hoistway 1, an upper terminal floor switch (upper terminal floor car detector) 14 for detecting arrival of the car 5 at the upper terminal floor is installed. Near a lower terminal floor in the hoistway 1, a lower terminal floor switch (lower terminal floor car detector) 15 for detecting arrival of the car 5 at the lower terminal floor is installed.

A switch operating member (rail) 16 for operating the upper terminal floor switch 14 and the lower terminal floor switch 15 is mounted to the car 5. Signals from the upper terminal floor switch 14 and the lower terminal floor switch 15 are transmitted to the safety monitor 8.

The configuration in which both the upper terminal floor switch 14 and the lower terminal floor switch 15 are installed is employed herein, but a configuration in which one of the switches is installed may be employed. Further, each terminal floor switch may be duplicated.

At a plurality of positions corresponding to a plurality of stop floors in the hoistway 1, landing plates 17 that are members to be detected are installed. In the car 5, a landing sensor 18 that is a position sensor for detecting the landing plate 17 is mounted. The landing sensor 18 detects that the car 5 is located in a door zone that is a safe door openable/closable range. Information on the door zone read by the landing sensor 18 is transmitted to the elevator controller 7. In order to improve reliability, two or more landing sensors 18 may be mounted to the car 5.

At arbitrary positions (or in door zone) in the hoistway 1, a plurality of storage media 19 capable of wireless communication are arranged. As each storage medium 19, for example, an RF tag (IC tag or the like) for radio frequency identification (RFID) is used. The storage media 19 are arranged in a hoisting direction of the car 5, that is, in a vertical direction so as to be spaced from one another. Each storage medium 19 stores individual identification information. The safety monitor 8 stores information for associating the individual identification information with a position in the hoistway 1.

In the car 5, a tag reader 20 serving as a reading device for reading information of the storage medium 19 in a noncontact manner is mounted. The information of the storage medium 19 read by the tag reader 20 is transmitted to the safety monitor 8. In order to improve reliability, two or more tag readers 20 may be mounted to the car 5. Two or more storage media 19 may be installed at the same position in the vertical direction.

According to this embodiment, intervals between two storage media 19 adjacent to each other in the vertical direction are all different from one another. A maximum value of the interval between the two storage media 19 adjacent to each other is determined based on time permitted for a restoring operation to be described later. Further, a minimum value of the interval between the two storage media 19 adjacent to each other is determined based on a traveling speed of the car 5 and a calculation period of a calculating portion of the safety monitor 8 after the information of the storage medium 19 has been read by the tag reader 20.

The safety monitor 8 monitors the presence or absence of overspeed traveling of the car 5. Further, when the safety monitor 8 detects overspeed traveling, the safety monitor 8 outputs a command signal for activating a hoisting machine brake.

Figure 2:
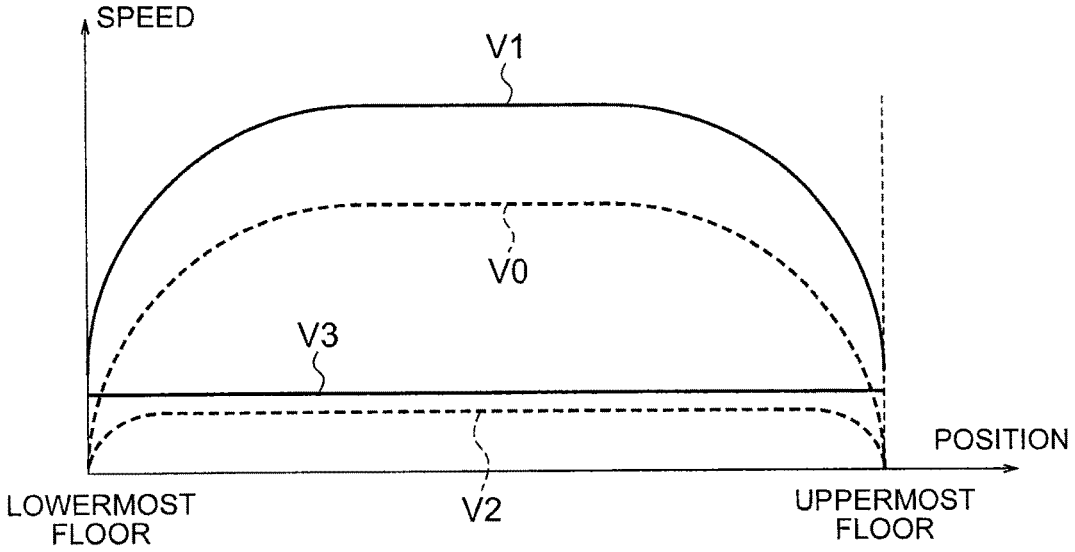
FIG. 2 is a graph for showing an overspeed monitoring reference set in a safety monitor in FIG. 1.

FIG. 2 is a graph showing an overspeed monitoring reference (first overspeed monitoring reference) V1 set in the safety monitor 8 in FIG. 1. In FIG. 2, a traveling curve V0 indicates a speed locus at the time when the car 5 normally travels from the upper terminal floor (or lower terminal floor) to the lower terminal floor (or upper terminal floor). The overspeed monitoring reference V1 is set higher than the traveling curve V0.

The overspeed monitoring reference V1 is a curve changed depending on a position of the car 5, and set to become continuously lower in a terminal direction near the lowermost floor and the uppermost floor, that is, near the terminal floors of the hoistway 1. Accordingly, by quickly detecting an overspeed near the end portion, a safe space taking an impact of the car 5 to the end portion into consideration can be reduced, and the shock absorbers 13*a* and 13*b* can be downsized.

Further, in order to prevent car swinging, a sensor error, a control error, or the like from being detected as an overspeed, a certain margin is secured between the traveling curve V0 and the overspeed monitoring reference V1.

As described above, the overspeed monitoring reference V1 changed depending on the position of the car 5 is used. Thus, the safety monitor 8 needs to detect the position of the car 5.

Next, a method of detecting the position of the car 5 by the safety monitor 8 is described. The safety monitor 8 detects a reference position of the car 5 based on signals from the upper terminal floor switch 14 and the lower terminal floor switch 15. Further, the safety monitor 8 measures a moving amount of the car 5 from the reference position based on a signal from the speed governor encoder 12 output along with the movement of the car 5, and detects the position of the car 5. This operation is based on the upper terminal floor switch 14 and the lower terminal floor switch 15, but the moving amount of the car 5 may be measured based on the position of the storage medium 19.

The safety monitor 8 detects a speed of the car 5 by carrying out calculation processing using the signal from the speed governor encoder 12. The safety monitor 8 compares the detected speed of the car 5 with the overspeed monitoring reference V1. The safety monitor 8 determines overspeed traveling when the detected speed of the car 5 is higher than the overspeed monitoring reference V1, and outputs a command signal for operating the hoisting machine brake.

<<Learning Operation>>

In order to execute the above-mentioned safety monitoring, the safety monitor 8 carries out a learning operation for storing positions of the upper terminal floor switch 14, the lower terminal floor switch 15, and the storage medium 19. In other words, operation modes of the safety monitor 8 include a learning operation mode.

Needless to say, the learning operation is carried out as an initial operation of the elevator apparatus. Further, the learning operation may be carried out during maintenance and inspection or during a slack period of the elevator apparatus. In any case, it is desired to execute the learning operation in an absent state of a user. Further, the learning operation may be automatically executed by the elevator apparatus, or manually by a maintenance and inspection engineer.

Figure 3:
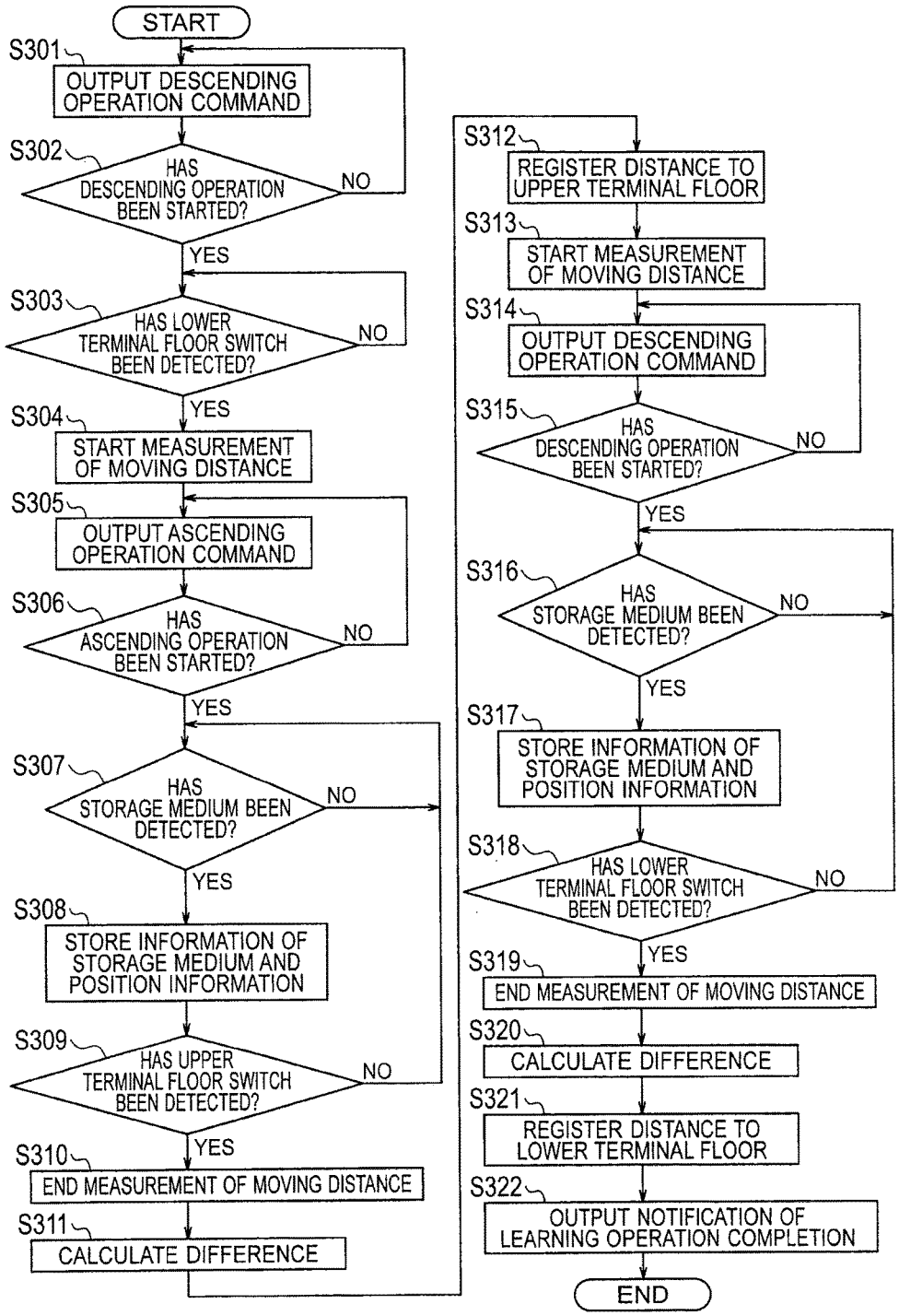
FIG. 3 is a flowchart showing a learning operation carried out by the safety monitor in FIG. 1.

Now, a learning operation method is described. FIG. 3 is a flowchart showing a learning operation carried out by the safety monitor 8 in FIG. 1. When the learning operation is started, the safety monitor 8 outputs a descending operation command to the elevator controller 7 (Step S301). Accordingly, the elevator controller 7 controls the car 5 to descend.

At this time, the elevator controller 7 is, as in the related art, ready to control the car 5 to stop at the terminal floor. Further, in view of responses of the storage medium 19 and the tag reader 20 and the processing speed of the safety monitor 8, it is desired that a traveling speed V2 of the car 5 during the learning operation be set to a speed enabling necessary accuracy to be achieved.

Further, an overspeed monitoring reference during the learning operation is set to an overspeed monitoring reference V3 (second overspeed monitoring reference shown in FIG. 2) of a fixed level enabling the car 5 to be safely stopped by the shock absorbers 13*a* and 13*b* irrespective of the position of the car 5.

After the descending operation command has been output, the safety monitor 8 confirms whether or not the descending operation has been started (Step S302). When the descending operation is yet to be started, the safety monitor 8 outputs a descending operation command to the elevator controller 7 again.

When the descending operation is started, the safety monitor 8 continues the descending operation of the car 5 until the lower terminal floor switch 15 is detected (Step S303). The car 5 is stopped at the lower terminal floor by the elevator controller 7.

When the lower terminal floor switch 15 is detected, the safety monitor 8 starts, based on a signal from the speed governor encoder 12, measurement of a moving distance of the car 5 from the lower terminal floor (Step S304). In this case, the two speed governor encoders 12 are coaxially mounted, and thus reliability of a measured value of a moving amount of the car 5 is improved by comparing measured moving amounts with each other.

Then, the safety monitor 8 outputs an ascending operation command to the elevator controller 7 (Step S305). Accordingly, the elevator controller 7 controls the car 5 to ascend.

After the ascending operation command has been output, the safety monitor 8 confirms whether or not the ascending operation has been started (Step S306). When the ascending operation is yet to be started, the safety monitor 8 outputs an ascending operation command to the elevator controller 7 again.

During the ascending operation, the safety monitor 8 confirms whether or not a storage medium 19 has been detected by the tag reader 20 (Step S307). When the storage medium 19 is detected, the safety monitor 8 stores a moving amount of the car 5 from the reference position (detection position of lower terminal floor switch 15) at the time of detection of the storage medium 19 and information of the storage medium 19 together (Step S308). This operation is continued until the safety monitor 8 detects the upper terminal floor switch 14 (Step S309). The car 5 is stopped at the upper terminal floor by the elevator controller 7.

When the upper terminal floor switch 14 is detected, the safety monitor 8 ends the measurement of the moving distance of the car 5 carried out based on the signal from the speed governor encoder 12 (Step S310). In this case, the safety monitor 8 recognizes a distance from the lower terminal floor switch 15 to the upper terminal floor switch 14.

Then, the safety monitor 8 calculates a difference between the distance from the lower terminal floor switch 15 to the upper terminal floor switch 14 obtained during the ascending operation and a distance from the detection position of the lower terminal floor switch 15 to a detection position of each storage medium 19 (Step S311). As a result, the safety monitor 8 obtains a distance from the detection position of each storage medium 19 to the detection position of the upper terminal floor switch 14. Then, the safety monitor 8 stores the distance from the detection position of each storage medium 19 to the detection position of the upper terminal floor switch 14 (Step S312).

Then, in order to store the distance from the detection position of each storage medium 19 to the detection position of the lower terminal floor switch 15, the safety monitor 8 carries out learning by a descending operation. In other words, when the storing operation (Step S312) has ended, the safety monitor 8 starts, based on the signal from the speed governor encoder 12, measurement of a moving distance of the car 5 from the upper terminal floor (Step S313).

Then, the safety monitor 8 outputs a descending operation command to the elevator controller 7 (Step S314). Accordingly, the elevator controller 7 controls the car 5 to descend.

After the descending operation command has been output, the safety monitor 8 confirms whether or not the descending operation has been started (Step S315). When the descending operation is yet to be started, the safety monitor 8 outputs a descending operation command to the elevator controller 7 again.

During the descending operation, the safety monitor 8 confirms whether or not a storage medium 19 has been detected by the tag reader 20 (Step S316). When the storage medium 19 is detected, the safety monitor 8 stores a moving amount of the car 5 from the reference position (detection position of upper terminal floor switch 14 at the time of detection of the storage medium 19 and information of the storage medium 19 together (Step S317). This operation is continued until the safety monitor 8 detects the lower terminal floor switch 15 (Step S318). The car 5 is stopped at the lower terminal floor by the elevator controller 7.

When the lower terminal floor switch 15 is detected, the safety monitor 8 ends the measurement of the moving distance of the car 5 carried out based on the signal from the speed governor encoder 12 (Step S319). In this case, the safety monitor 8 recognizes a distance from the upper terminal floor switch 14 to the lower terminal floor switch 15.

Then, the safety monitor 8 calculates a difference between the distance from the upper terminal floor switch 14 to the lower terminal floor switch 15 obtained during the descending operation and a distance from the detection position of the upper terminal floor switch 14 to a detection position of each storage medium 19 (Step S320). As a result, the safety monitor 8 obtains a distance from the detection position of each storage medium 19 to the detection position of the lower terminal floor switch 15. Then, the safety monitor 8 stores the distance from the detection position of each storage medium 19 to the detection position of the lower terminal floor switch 15 (Step S321).

When the storage operation (Step S321) has ended, the safety monitor 8 outputs a notification of learning operation completion to the elevator controller 7 (Step S322). When the elevator controller 7 receives the notification, the elevator controller 7 starts (or resumes) normal operation services.

Through this learning operation, the safety monitor 8 stores the distance from the detection position of each storage medium 19 to the detection position of the upper terminal floor switch 14 and the distance from the detection position of each storage medium 19 to the detection position of the lower terminal floor switch 15. Further, the safety monitor 8 measures and stores an interval between the storage media 19.

<<Restoring Operation>>

Incidentally, when the position of the car 5 cannot be grasped, for example, when a power supply to the safety monitor 8 is cut off during a normal operation, the safety monitor 8 stops the function without following the procedure of storing position information of the car 5 at that time.

On the other hand, the following method may be employed. The safety monitor 8 may store the position information of the car 5 when it is recognized that the power supply is cut off, and resume the overspeed monitoring by using the stored position information when the power supply is resumed. However, in the case of this method, when the car 5 moves for some reason during the power supply cut-off, the car position information may shift, thus causing the safety monitor 8 to execute erroneous overspeed monitoring.

Therefore, when the power supply is cut off, the safety monitor 8 stops the function without following the procedure of storing the position information, and executes a restoring operation when the power supply is resumed. In other words, the operation modes of the safety monitor 8 include a restoring operation mode.

Figure 4:
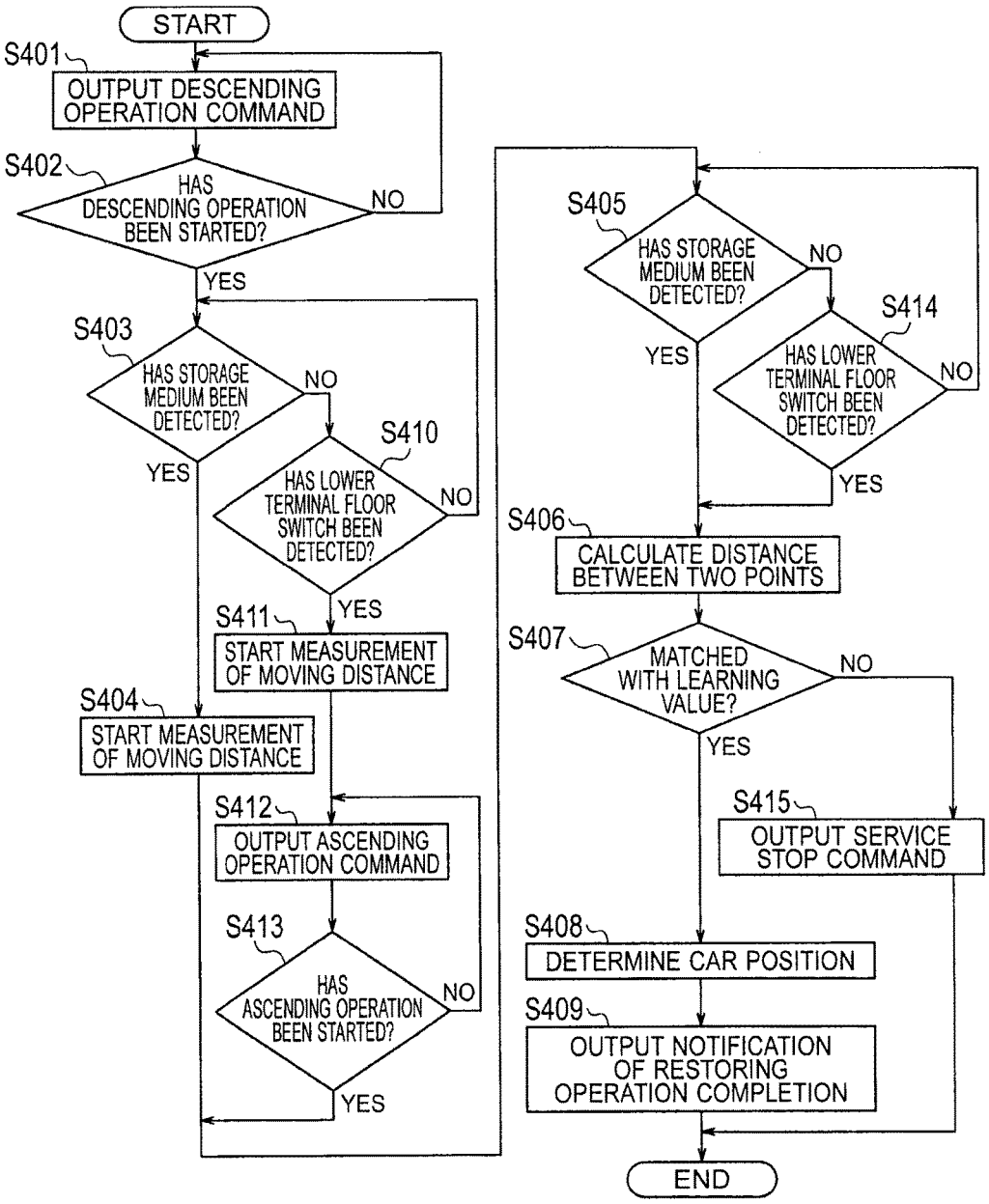
FIG. 4 is a flowchart showing a restoring operation carried out by the safety monitor in FIG. 1.

Now, a restoring operation method is described. FIG. 4 is a flowchart showing a restoring operation carried out by the safety monitor 8 in FIG. 1. When the learning operation is started, the safety monitor 8 outputs a descending operation command to the elevator controller 7 (Step S401). Accordingly, the elevator controller 7 controls the car 5 to descend.

In this case, the restoring operation is an operation for restoring the elevator apparatus to normal services. Thus, unlike the learning operation, it is desired that the car 5 travel at a maximum speed V2 determined based on specifications of the shock absorbers 13*a* and 13*b*. Further, an overspeed monitoring reference during the restoring operation is set to the overspeed monitoring reference V3 (second overspeed monitoring reference shown in FIG. 2) of a fixed level enabling the car 5 to be safely stopped by the shock absorbers 13*a* and 13*b* irrespective of the position of the car 5.

After the descending operation command has been output, the safety monitor 8 confirms whether or not the descending operation has been started (Step S402). When the descending operation is yet to be started, the safety monitor 8 outputs a descending operation command to the elevator controller 7 again.

During the descending operation, the safety monitor 8 confirms whether or not a storage medium 19 has been detected by the tag reader 20 (Step S403). When the storage medium 19 is detected, the safety monitor 8 starts, based on a signal from the speed governor encoder 12, measurement of a moving amount of the car 5 from the detected storage medium 19 (Step S404).

Then, the safety monitor 8 confirms whether or not a second storage medium 19 has been detected (Step S405). When the second storage medium 19 is detected, the safety monitor 8 calculates an interval between the first storage medium 19 and the second storage medium 19 (Step S406). Then, the safety monitor 8 compares the calculated interval with the information that has already been stored during the learning operation, that is, the interval between the two storage media 19 adjacent to each other (Step S407).

When the calculated interval is matched with the interval stored in the safety monitor 8, the safety monitor 8 determines the position of the car 5 at a position of the second storage medium 19 (Step S408).

According to this embodiment, the intervals between the two storage media 19 adjacent to each other are all different from one another, and thus by measuring the interval between the two storage media 19 and comparing the measured interval with the interval stored in advance, the position of the car 5 can be uniquely grasped with use of a result of the comparison and the information stored in the storage medium 19. Note that, a current position of the car 5 is obtained by adding a moving amount from the second storage medium 19 to a detection position of the second storage medium 19.

When the position of the car 5 is determined, the safety monitor 8 outputs a notification of restoring operation completion to the elevator controller 7 (Step S409). When the safety monitor 8 receives the notification, the elevator controller 7 resumes normal operation services.

The above-mentioned operation is an operation carried out when the two storage media 19 have been successfully detected by the descending operation. However, depending on a position of the car 5 at the time of starting the restoring operation, the two storage media 19 may not be detected by the descending operation.

Therefore, the safety monitor 8 confirms whether or not the lower terminal floor switch 15 has been detected before detection of the first storage medium 19 (Step S410). The safety monitor 8 also confirms whether or not the lower terminal floor switch 15 has been detected before detection of the second storage medium 19 (Step S414).

When the lower terminal floor switch 15 has been detected before detection of the first storage medium 19, the safety monitor 8 starts, based on a signal from the speed governor encoder 12, measurement of a moving amount of the car 5 from the lower terminal floor switch 15 (Step S411).

Then, the safety monitor 8 outputs an ascending operation command to the elevator controller 7 (Step S412). Accordingly, the elevator controller 7 controls the car 5 to ascend.

After the ascending operation command has been output, the safety monitor 8 confirms whether or not the ascending operation has been started (Step S413). When the ascending operation is yet to be started, the safety monitor 8 outputs an ascending operation command to the elevator controller 7 again.

During the ascending operation, the safety monitor 8 confirms whether or not a storage medium 19 has been detected by the tag reader 20 (Step S405). When the storage medium 19 is detected, the safety monitor 8 calculates a distance from the detection position of the lower terminal floor switch 15 to a detection position of a storage medium 19 detected first (Step S406). Then, the safety monitor 8 compares the calculated distance with the distance information that has already been stored by the learning operation, that is, the distance from the detection position of the lower terminal floor switch 15 to a detection position of a storage medium 19 adjacent thereto (Step S407).

When the calculated distance is matched with the distance stored in the safety monitor 8, the safety monitor 8 determines the position of the car 5 at a position of the storage medium 19 detected first (Step S408). An operation thereafter is similar to that carried out when the two storage media 19 are successfully detected only by the descending operation.

When the lower terminal floor switch 15 has been detected after detection of the first storage medium 19 and before detection of the second storage medium 19, the safety monitor 8 calculates a distance from a detection position of the first storage medium 19 to the detection position of the lower terminal floor switch 15 (Step S406). Then, the safety monitor 8 compares the calculated distance with the information that has already been stored by the learning operation, that is, the distance from the detection position of the lower terminal floor switch 15 to the detection position of the storage medium 19 adjacent thereto (Step S407).

When the calculated distance is matched with the distance stored in the safety monitor 8, the safety monitor 8 determines the position of the car 5 at a position of the lower terminal floor switch 15 (Step S408). An operation thereafter is similar to that carried out when the two storage media 19 are successfully detected only by the descending operation.

When the calculated value and the learning value are not matched with each other in Step S407, the safety monitor 8 outputs a command for stopping the operation services to the elevator controller 7 (Step S415). Accordingly, the elevator apparatus 7 stops the operation services in accordance with the command from the safety monitor 8.

In place of the above-mentioned method of carrying out the position detection based on the distance between the two points, a method of carrying out position detection based on only position information of one storage medium 19 may be employed. However, in the case of this method, when the storage medium 19 or the tag reader 20 is in a failed state, an erroneous position is recognized, thus causing the safety monitor 8 to execute erroneous overspeed monitoring.

According to this embodiment, by measuring the distance between the two points based on the signal from the doubled speed governor encoder 12 and comparing and confirming the measured distance with the value stored by the learning operation, the position of the car 5 can be determined while executing failure diagnosis for the storage medium 19 and the tag reader 20.

Further, when the calculated value and the learning value are not matched with each other, that is, when a failure of the equipment used for grasping the position of the car 5 is detected, the safety monitor 8 may output a restoring operation command again rather than outputting the command for stopping the operation services. Alternatively, as shown in FIG. 2, the safety monitor 8 may provide a service for driving the car 5 with the traveling speed of the car 5 limited to the speed V2 lower than the normal traveling speed V0. In this case, in the safety monitor 8, the overspeed monitoring reference V3 is set in accordance with the specifications of the shock absorbers 13*a* and 13*b*.

<<Interval Between Storage Media>>

Figure 5:
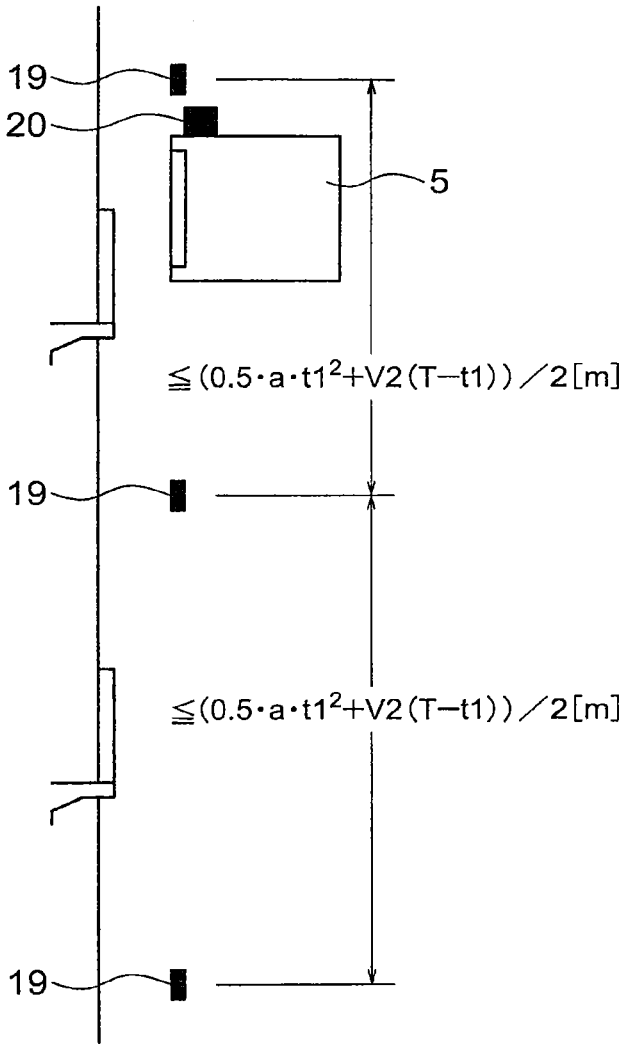
FIG. 5 is an explanatory diagram showing intervals of storage media in the elevator apparatus in FIG. 1.

Next, concerning the storage media 19 arbitrarily arranged as described above, a specific interval between the two storage media 19 adjacent to each other is described referring to FIG. 5. FIG. 5 is an explanatory diagram showing intervals between the storage media 19 in the elevator apparatus in FIG. 1.

During the restoring operation according to this embodiment, basically, two storage media 19 are detected. For example, assuming that the car 5 has started a restoring operation from a position illustrated in FIG. 5 (immediately after passage through highest storage medium 19 illustrated in FIG. 5), the car 5 is required to travel by a distance for about three storage media before the second storage medium 19 is detected.

In this case, a maximum distance X between the two storage media adjacent to each other is set within a value obtained by the following expression:

$$X=(0.5\times a\times t1^2+V2(T-t1))/2 \text{ [m]}$$

where V [m/min] is a traveling speed of the car 5 permitted during the restoring operation (this speed is determined based on specifications of shock absorbers 13*a* and 13*b*), a [m/s$^2$] is acceleration until the traveling speed V is reached, t1 [s] is time until the traveling speed V is reached, and T [min] is time permitted before restoration. Then, the restoration is completed within the time T [min] permitted before the restoration.

As described above, in the elevator apparatus according to this embodiment, the storage media 19 are arranged in the hoisting direction of the car 5 at the different intervals, and the intervals of the storage media 19 are stored in the safety monitor 8. When the position of the car 5 cannot be grasped, the operation for detecting the two storage media 19 is carried out, the interval between the detected storage media 19 is measured based on the signal from the speed governor encoder 12, the measured interval between the storage media 19 is compared with the stored interval between the storage media 19, and the position of the car 5 is grasped by using a result of the comparison and the information of the storage media. Therefore, when the position of the car 5 cannot be grasped, by using the storage media 19, highly reliable car position detection applicable even to safety monitoring can be carried out.

Further, even when the position of the car 5 cannot be grasped, safety can be secured by monitoring the speed based on a low overspeed monitoring reference.

Second Embodiment

Figure 6:
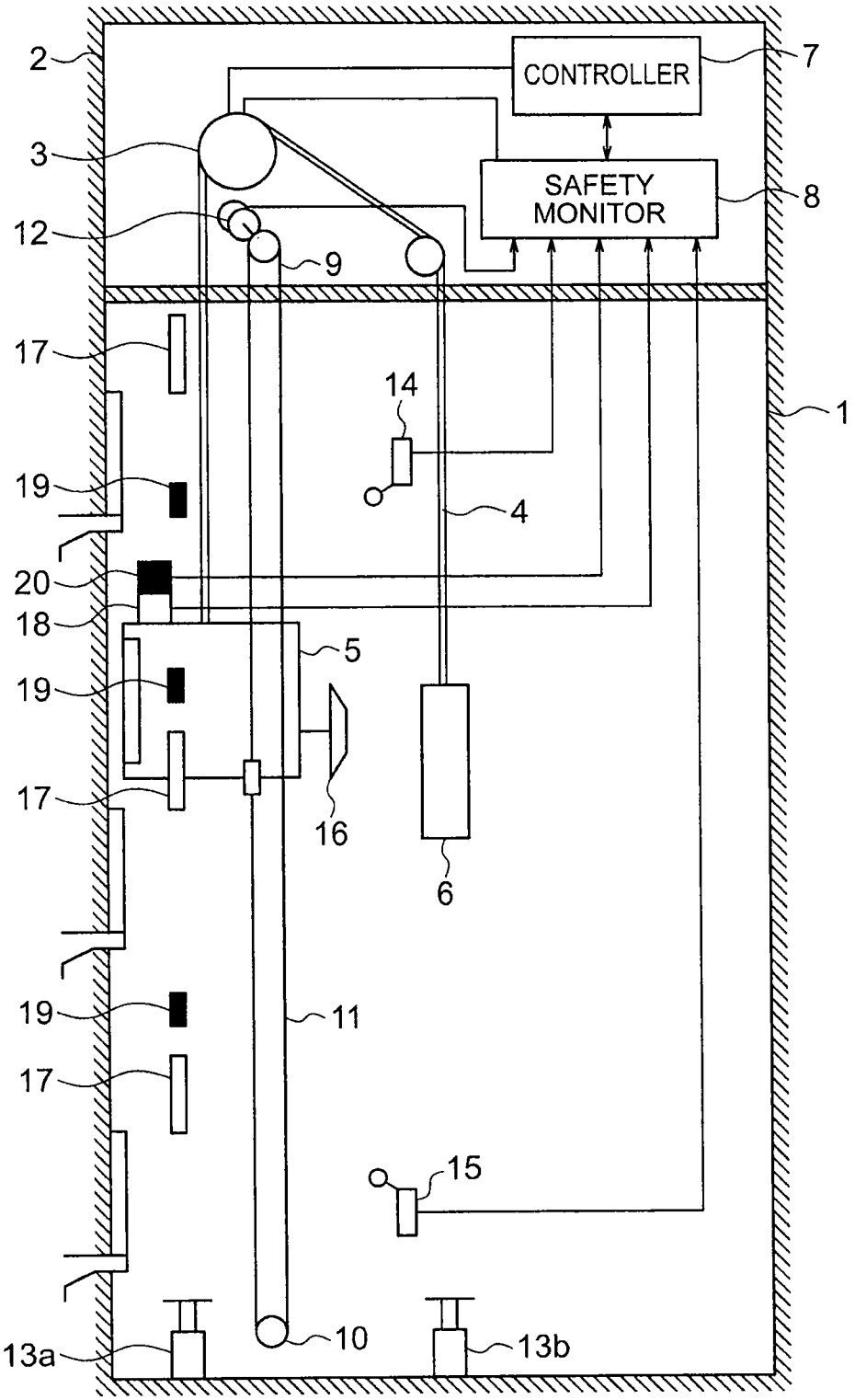
FIG. 6 is a configuration diagram showing an elevator apparatus according to a second embodiment of the present invention.

Next, FIG. 6 is a configuration diagram showing an elevator apparatus according to a second embodiment of the present invention. According to the second embodiment, a signal from the landing sensor 18 is input not to the elevator controller 7 but to the safety monitor 8. In other words, information obtained by reading the landing plate 17 via the landing sensor 18 is used for safety monitoring. The remaining configuration is the same as that of the first embodiment.

Note, however, that the signal from the landing sensor 18 may be input not only to the safety monitor 8 but also to the elevator controller 7 after branching. In this case, for example, when abnormality occurs in a power source (not shown) for supplying power to the elevator controller 7 or in a power source (not shown) for supplying power to the safety monitor 8, large current may flow from the elevator controller 7 to the safety monitor 8 or from the safety monitor 8 to the elevator controller 7, thus causing a control function of the controller 7 and a safety monitoring function of the safety monitor 8 to be simultaneously lost. Therefore, it is desired that a photocoupler be used to insulate the controller 7 and the safety monitor 8 (arrow part between controller 7 and safety monitor 8 illustrated in FIG. 6).

By directly inputting the signal from the landing sensor 18 to the elevator controller 7 not via the safety monitor 8, processing for an output terminal of the safety monitor 8 and signal transmission can be reduced.

Further, a method of detecting a position of the car 5 by the safety monitor 8 is basically similar to that of the first embodiment. However, the safety monitor 8 according to the second embodiment corrects, when the landing sensor 18 detects the landing plate 17 during traveling of the car 5, a moving amount from a reference position measured based on a signal from the speed governor encoder 12 by using position information of the landing plate 17 stored in advance. Thus, detection accuracy of the position of the car 5 can be increased to be higher than that of the first embodiment.

For example, the position of the car 5 measured based on the signal from the speed governor encoder 12 has a slight error due to slipping between the speed governor sheave and the speed governor rope 11. On the other hand, according to this embodiment, slight errors can be prevented from being integrated into a large error.

<<Learning Operation>>

Figure 7:
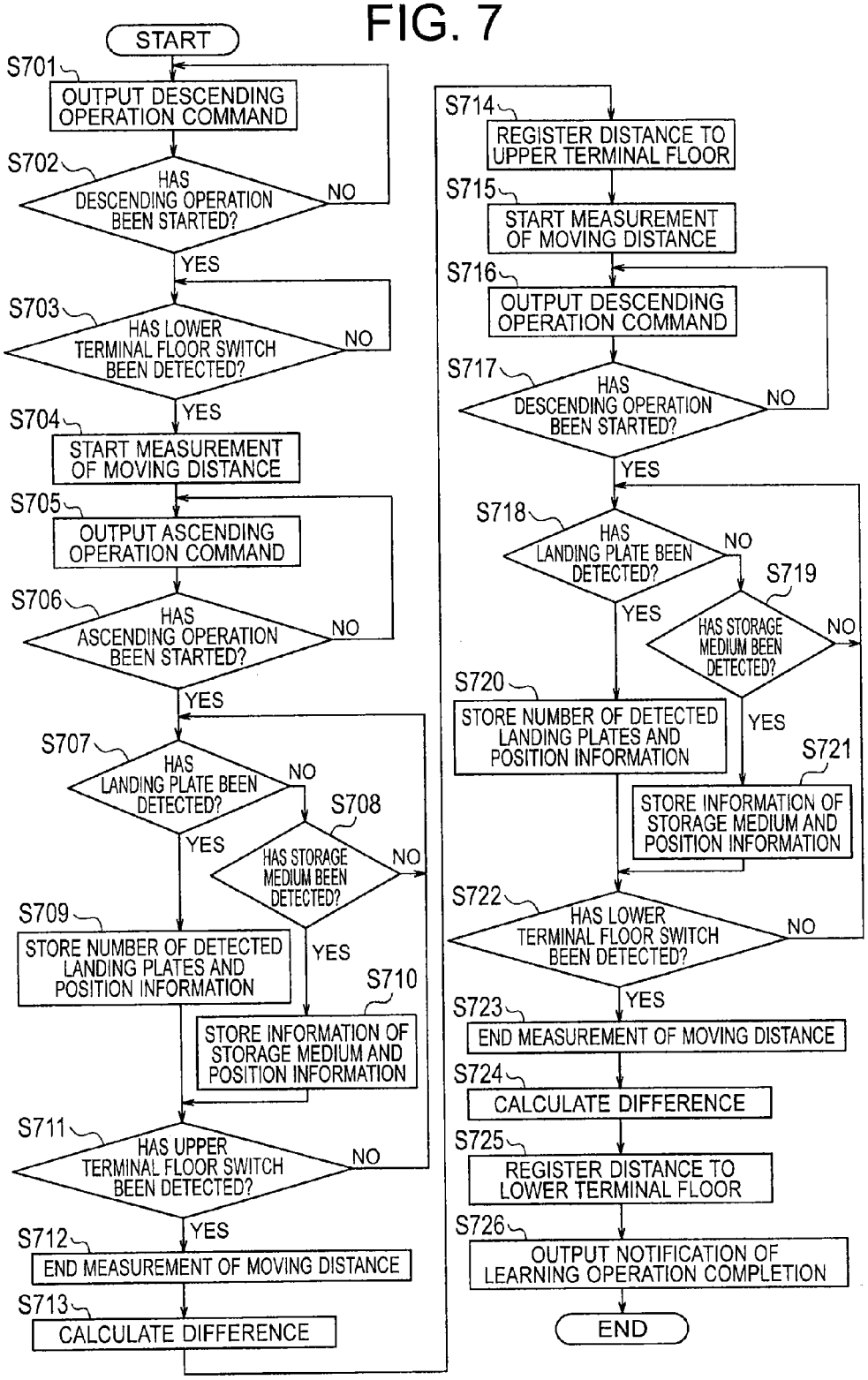
FIG. 7 is a flowchart showing a learning operation carried out by the safety monitor in FIG. 6.

In order to correct the above-mentioned position information, the safety monitor 8 also stores a detection position of the landing plate 17 during a learning operation. FIG. 7 is a flowchart showing a learning operation carried out by the safety monitor 8 in FIG. 6. An operation of Step S701 to Step S706 illustrated in FIG. 7 is similar to that of Step S301 to Step S306 illustrated in FIG. 3.

During an ascending operation in the learning operation, the safety monitor 8 according to the second embodiment confirms whether or not a landing plate 17 has been detected by the landing sensor 18 (Step S707), and confirms whether or not a storage medium 19 has been detected by the tag reader 20 (Step S708).

When the landing sensor 18 is detected, the safety monitor 8 stores a moving amount of the car 5 from a reference position (detection position of lower terminal floor switch 15) at the time of detection of the landing plate 17 and the number of detected landing sensors 18 together (Step S709).

When the storage medium 19 is detected, the safety monitor 8 stores a moving amount of the car 5 from the reference position (detection position of lower terminal floor switch 15) at the time of detection of the storage medium 19 and information of the storage medium 19 together (Step S710). This operation is continued until the safety monitor 8 detects the upper terminal floor switch 14 (Step S711).

An operation of Step S712 to Step S717 illustrated in FIG. 7 thereafter is approximately similar to that of Step S310 to Step S315 illustrated in FIG. 3. However, in difference calculation of Step S713, a difference between a distance from the lower terminal floor switch 15 to the upper terminal floor switch 14 and a distance from the detection position of the lower terminal floor switch 15 to a detection position of the landing plate 17 is also calculated. Then, in Step S714, a distance from the detection position of the landing plate 17 to a detection position of the upper terminal floor switch 14 is also stored.

During a descending operation in the learning operation, the safety monitor 8 confirms whether or not the landing plate 17 has been detected by the landing sensor 18 (Step S718), and confirms whether or not a storage medium 19 has been detected by the tag reader 20 (Step S719).

When the landing sensor 18 is detected, the safety monitor 8 stores a moving amount of the car 5 from a reference position (detection position of upper terminal floor switch 14) at the time of detection of the landing plate 17 and the number of detected landing sensors 18 together (Step S720).

When the storage medium 19 is detected, the safety monitor 8 stores a moving amount of the car 5 from the reference position (detection position of upper terminal floor switch 14) at the time of detection of the storage medium 19 and information of the storage medium 19 together (Step S721). This operation is continued until the safety monitor 8 detects the lower terminal floor switch 15 (Step S722).

An operation of Step S723 to Step S726 illustrated in FIG. 7 thereafter is approximately similar to that of Step S319 to Step S322 illustrated in FIG. 3. However, in difference calculation of Step S724, a difference between a distance from the upper terminal floor switch 14 to the lower terminal floor switch 15 and a distance from the detection position of the upper terminal floor switch 14 to a detection position of the landing plate 17 is also calculated. Then, in Step S725, a distance from the detection position of the landing plate 17 to a detection position of the lower terminal floor switch 15 is also stored.

Through this learning operation, the safety monitor 8 stores a distance from a detection position of each landing plate 17 to the detection position of the upper terminal floor switch 14, a distance from the detection position of each landing plate 17 to the detection position of the lower terminal floor switch 15, a distance from a detection position of each storage medium 19 to the detection position of the upper terminal floor switch 14, and a distance from the detection position of each storage medium 19 to the detection position of the lower terminal floor switch 15. Further, the safety monitor 8 can also store an interval between the landing plates 17, an interval between the storage media 19, and a distance from the detection position of the landing plate 17 to a detection position of a storage medium 19 adjacent thereto.

According to this embodiment, not only the position of each storage medium 19 but also the position of each landing plate 17 is simultaneously stored. Thus, the safety monitor 8 can recognize a position of the car 5 by using a signal from the landing sensor 18.

<<Restoring Operation>>

Next, a restoring operation carried out by the safety monitor 8 according to the second embodiment is described. According to the first embodiment, the position of the car 5 is determined basically by measuring the distance between the two storage media 19. However, reading accuracy of the storage medium 19 is lower in the tag reader 20 than in the landing sensor 18. Therefore, according to this embodiment, the landing sensor 18 during the restoring operation is used to determine the position of the car 5 more accurately.

Figure 8:
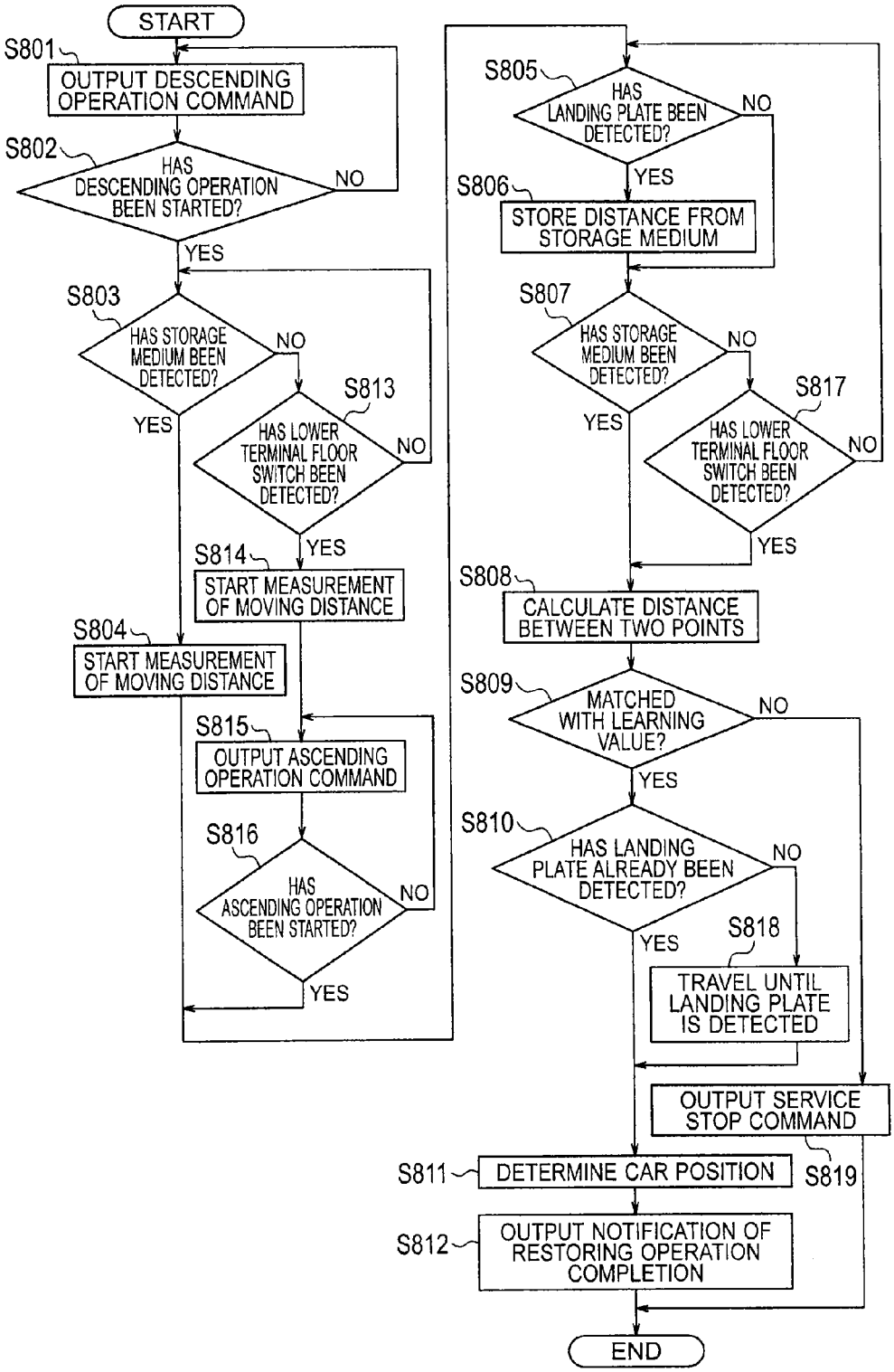
FIG. 8 is a flowchart showing a restoring operation carried out by the safety monitor in FIG. 6.

FIG. 8 is a flowchart showing the restoring operation carried out by the safety monitor 8 in FIG. 6. An operation of Step S801 to Step S804 illustrated in FIG. 8 is similar to that of Step S401 to Step S404 illustrated in FIG. 4.

After a first storage medium 19 has been detected by a descending operation, the safety monitor 8 continues the descending operation until a second storage medium 19 is detected. During this period, the safety monitor 8 confirms whether or not a landing plate 17 has been detected by the landing sensor 18 (Step S805). When the landing sensor 18 is detected, the safety monitor 8 stores a distance from a detection position of the first storage medium 19 to a detection position of the landing sensor 18 (Step S806).

The landing plate 17 may be detected any number of times after the first storage medium 19 has been detected. Each time the landing plate 17 is detected, the safety monitor 8 stores a distance from the detection position of the first storage medium 19 to a detection position of the landing plate 17.

By measuring the distance from the detection position of the first storage medium 19 to the detection position of the landing plate 17, the safety monitor 8 can recognize where the detected landing plate 17 is located in the hoistway 1.

Then, when a second storage medium 19 is detected by the tag reader 20 (Step S807), the safety monitor 8 calculates an interval between the first storage medium 19 and the second storage medium 19 (Step S808). Then, the safety monitor 8 compares the calculated interval with the information that has already been stored by the learning operation, that is, the interval between the two storage media 19 adjacent to each other (Step S809).

When the calculated value and a learning value are matched with each other, the safety monitor 8 confirms whether or not one or more landing plates 17 have been detected before detection of the second storage medium 19 (Step S810).

When one or more landing plates 17 are detected, the safety monitor 8 determines the position of the car 5 at a detection position of the landing plate 17 detected last (Step S811). Note that, a current position of the car 5 is obtained by adding a moving amount from the landing plate 17 detected last to the detection position of the landing plate 17 detected last.

When any landing plate 17 has not been detected before detection of the second storage medium 19, the car 5 is controlled to travel until a landing plate 17 is detected (Step S818). Then, after detection of the landing plate 17, the safety monitor 8 determines the position of the car 5 at a detection position of the landing plate 17.

After the position of the car 5 has been determined, the safety monitor 8 outputs a notification of restoring operation completion to the elevator controller 7 (Step S812). When the elevator controller 7 receives the notification, the elevator controller 7 resumes normal operation services.

The safety monitor 8 confirms whether or not the lower terminal floor switch 15 has been detected before detection of the first storage medium 19 (Step S813). Further, the safety monitor 8 also confirms whether or not the lower terminal floor switch 15 has been detected before detection of the second storage medium 19 (Step S817).

An operation of Step S813 to Step S816 illustrated in FIG. 8 is similar to that of Step S410 to Step S413 illustrated in FIG. 4.

When the lower terminal floor switch 15 has been detected before detection of the first storage medium 19, and the car 5 has been changed to an ascending operation, the safety monitor 8 continues the ascending operation until a storage medium 19 is detected. During this period, the safety monitor 8 confirms whether or not a landing plate 17 has been detected by the landing sensor 18 (Step S805).

When a landing plate 17 is detected by the landing sensor 18, the safety monitor 8 stores a distance from the detection position of the lower terminal floor switch 15 to a detection position of the landing plate 17 (Step S806). The landing plate 17 may be detected any number of times after the lower terminal floor switch 15 has been detected. Each time the landing plate 17 is detected, the safety monitor 8 stores a distance from the detection position of the lower terminal floor switch 15 to the detection position of the landing plate 17.

During the ascending operation, when storage media 19 are detected, the safety monitor 8 calculates a distance from the detection position of the lower terminal floor switch 15 to a detection position of a storage medium 19 detected first (Step S808). Then, the safety monitor 8 compares the calculated distance with the information that has already been stored by the learning operation, that is, the distance from the detection position of the lower terminal floor switch 15 to a detection position of a storage medium 19 adjacent thereto (Step S809).

When the calculated value and a learning value are matched with each other, the safety monitor 8 confirms whether or not one or more landing plates 17 have been detected before detection of the storage medium 19 (Step S810).

When one or more landing plates 17 are detected, the safety monitor 8 determines the position of the car 5 at a detection position of a landing plate 17 detected last (Step S811). In this case, a current position of the car 5 is obtained by adding a moving amount from the landing plate 17 detected last to the detection position of the landing plate 17 detected last.

When any landing plate 17 has not been detected before detection of the storage medium 19, the car 5 is controlled to travel until a landing plate 17 is detected (Step S818). Then, after detection of the landing plate 17, the safety monitor 8 determines the position of the car 5 at a detection position of the landing plate 17.

When the lower terminal floor switch 15 has been detected after detection of the first storage medium 19 and before detection of the second storage medium 19, the safety monitor 8 calculates a distance from a detection position of the first storage medium 19 to the detection position of the lower terminal floor switch 15 (Step S808). Then, the safety monitor 8 compares the calculated distance with the information that has already been stored by the learning operation, that is, the distance from the detection position of the lower terminal floor switch 15 to the detection position of the storage medium 19 adjacent thereto (Step S809).

When the calculated distance is matched with the distance stored in the safety monitor 8, the safety monitor 8 determines the position of the car 5 at the detection position of the lower terminal floor switch 15 (Step S811).

In Step S809, an operation carried out when the calculated value and a learning value are not matched with each other is similar to that of the first embodiment.

According to this embodiment, in addition to the storage medium 19, by using information obtained based on a combination of the landing plate 17 and the highly accurate landing sensor 18, the position of the car 5 can be determined more accurately than the first embodiment.

Third Embodiment

Next, a third embodiment of the present invention is described. A configuration of an elevator apparatus according to the third embodiment is similar to that of the second embodiment. A learning operation carried out by the safety monitor 8 is also similar to that of the second embodiment. However, the safety monitor 8 according to the third embodiment grasps, during a restoring operation, a position of the car 5 by using a distance from a detection position of a storage medium 19 stored by the learning operation to a detection position of a landing plate 17 adjacent thereto, information of the detected storage medium 19, and position information of the detected landing plate 17.

<<Restoring Operation>>

Now, the restoring operation carried out by the safety monitor 8 according to the third embodiment is described. According to the second embodiment, after the distance between the two storage media 19 has been measured to confirm the matching of the measured value with the learning value, the position of the car 5 is determined based on the detection position of the landing plate 17. On the other hand, according to the third embodiment, after a distance from a detection position of a storage medium 19 to a detection position of a landing plate 17 has been measured to confirm matching of the measured value with a learning value, the position of the car 5 is determined based on the detection position of the landing plate 17.

Figure 9:
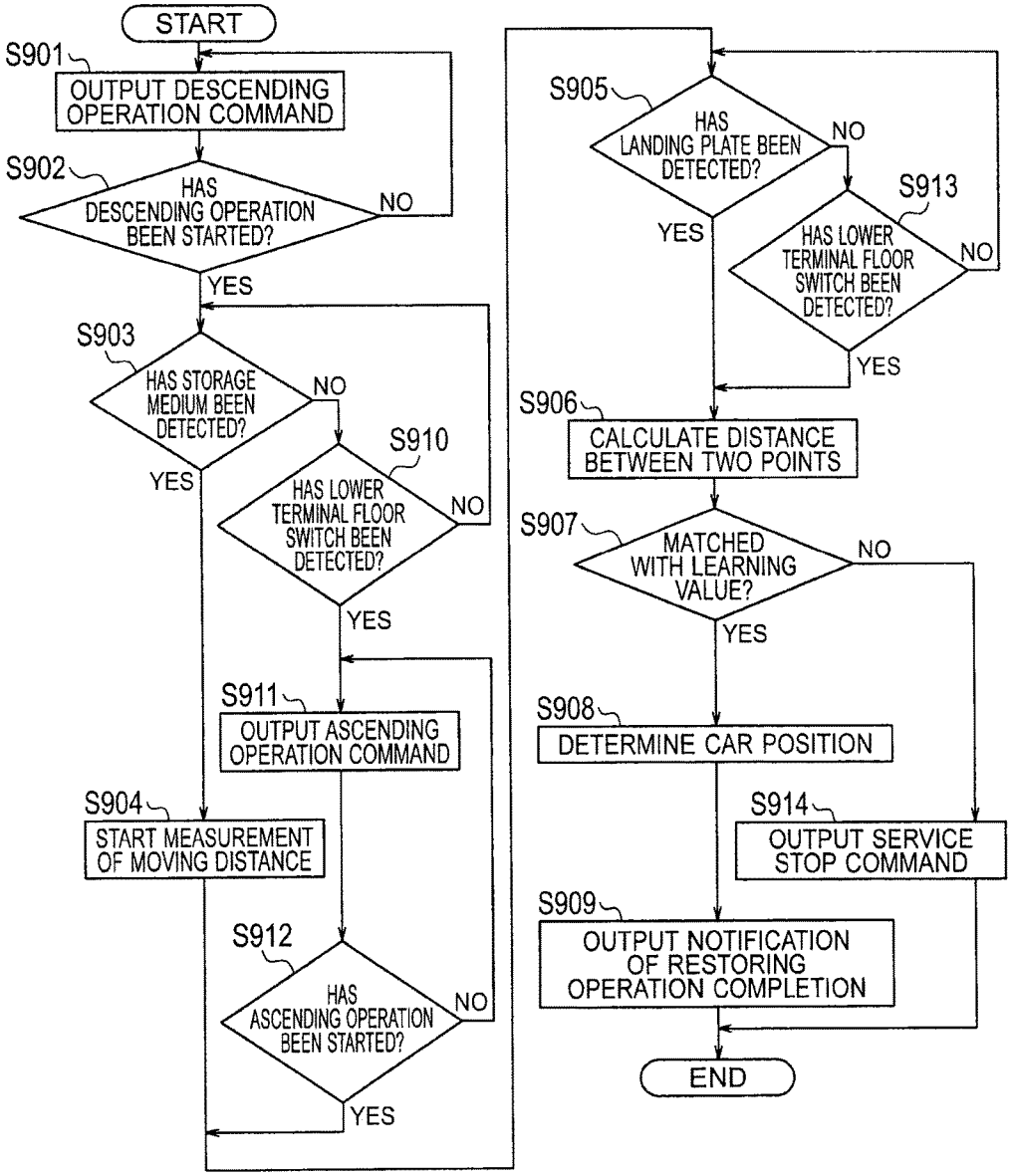
FIG. 9 is a flowchart showing a restoring operation carried out by a safety monitor according to a third embodiment of the present invention.

FIG. 9 is a flowchart showing the restoring operation carried out by the safety monitor 8 according to the third embodiment. An operation of Step S901 to Step S904 illustrated in FIG. 9 is similar to that of Step S401 to Step S404 illustrated in FIG. 4.

After a storage medium 19 has been detected by a descending operation, the safety monitor 8 continues the descending operation until a landing plate 17 is detected.

Then, when a landing plate 17 is detected by the landing sensor 18 (Step S905), the safety monitor 8 calculates a distance from a detection position of the storage medium 19 to a detection position of the landing plate 17 (Step S906). Then, the safety monitor 8 compares the calculated distance with information that has already been stored by the learning operation (Step S907).

When the calculated distance and the learning value are matched with each other, the safety monitor 8 determines the position of the car 5 at the detection position of the landing plate 17 (Step S908). In this case, a current position of the car 5 is obtained by adding a moving amount from the detected landing plate 17 to the detection position of the detected landing plate 17.

After the position of the car 5 has been determined, the safety monitor 8 outputs a notification of restoring operation completion to the elevator controller 7 (Step S909). When the elevator controller 7 receives the notification, the elevator controller 7 resumes normal operation services.

The safety monitor 8 confirms whether or not the lower terminal floor switch 15 has been detected before detection of the storage medium 19 (Step S910). Further, the safety monitor 8 confirms whether or not the lower terminal floor switch 15 has been detected before detection of the landing plate 17 (Step S913).

An operation of Step S910 to Step S912 illustrated in FIG. 9 is similar to that of Step S410, Step S412, and Step S413 illustrated in FIG. 4.

When the lower terminal floor switch 15 has been detected before detection of the storage medium 19, and the car 5 has been changed to an ascending operation, the safety monitor 8 continues the ascending operation until a storage medium 19 is detected. An operation after the storage medium 19 has been detected is similar to that in the descending operation.

When the lower terminal floor switch 15 is detected after detection of the storage medium 19 and before detection of the landing plate 17, the safety monitor 8 calculates a distance from a detection position of the storage medium 19 to the detection position of the lower terminal floor switch 15 (Step S906). Then, the safety monitor 8 compares the calculated distance with the information that has already been stored by the learning operation, that is, the distance from the detection position of the lower terminal floor switch 15 to the detection position of the storage medium 19 adjacent thereto (Step S907).

When the calculated distance is matched with the distance stored in the safety monitor 8, the safety monitor 8 determines the position of the car 5 at the detection position of the lower terminal floor switch 15 (Step S908).

An operation carried out when the calculated value and the learning value are matched with each other in Step S907 is similar to those of the first and second embodiments.

In such an elevator apparatus, based on the interval between the storage medium 19 and the landing plate 17 adjacent thereto, the position of the car 5 can be determined highly accurately while diagnosing the information of the storage medium 19. Therefore, when the position of the car 5 cannot be grasped, highly reliable car position detection applicable even to safety monitoring can be carried out by using the storage medium 19.

The movement detector is not limited to the speed governor encoder. For example, the movement detector may be a rotation detector mounted to a sheave around which suspension body is wound, a distance sensor for continuously detecting car movement, or the like.

The reading device is selected depending on the type of the storage medium 19, and thus not limited to the tag reader.

Further, the member to be detected is not limited to the landing plate 17, and the position sensor is not limited to the landing sensor 18. For example, as the member to be detected, a plate arranged at an arbitrary position in the hoistway may be used. A magnetic member to be detected may also be used.

Further, the monitoring target of the safety monitor is not limited to the overspeed traveling. For example, the presence or absence of door-open traveling may be monitored.

The equipment layout, the roping method, and the like of the entire elevator apparatus are not limited to those in the examples illustrated in FIG. 1 and FIG. 6. For example, the present invention can be applied to an elevator apparatus of 2:1 roping. For example, the positions and the number of hoisting machines are not limited to those in the examples illustrated in FIG. 1 and FIG. 6.

Further, the present invention can be applied to various types of elevator apparatus such as a machine-room-less elevator, a double-deck elevator, an elevator of a one-shaft multicar type, and an inclined elevator.

The invention claimed is:

1. An elevator apparatus, comprising:

a car;

movement detector that generates a signal in accordance with movement of the car;

a plurality of storage media arranged in a hoistway so as to be spaced from one another in a hoisting direction of the car;

reading device mounted to the car, that reads individual identification information stored in the plurality of storage media; and a safety monitor that detects a moving amount and a position of the car by using the signal from the movement detector and monitoring presence or absence of abnormality in an operation state of the car, wherein the plurality of storage media are arranged in the hoisting direction of the car at intervals different from one another, wherein the safety monitor is configured to store the intervals of the plurality of storage media, and wherein the safety monitor is configured to: execute an operation for detecting two of the plurality of storage media; measure an interval between the detected two of the plurality of storage media based on the signal from the movement detector; compare the measured interval between the two of the plurality of storage media with the stored intervals of the plurality of storage media; and to grasp the position of the car by using a result of the comparison and the individual identification information of the plurality of storage media, when the position of the car is unable to be grasped.

2. The elevator apparatus according to claim 1, further comprising terminal floor car detector that detects arrival of the car at a terminal floor, wherein operation modes of the safety monitor include a learning operation mode, and wherein, in the learning operation mode, the safety monitor is configured to: measure a distance from a detection position of the terminal floor car detector to a detection position of the storage medium based on the signal from the movement detector; and to store the distance from the detection position of the terminal floor car detector to the detection position of the storage medium and the intervals of the plurality of storage media.

3. The elevator apparatus according to claim 2, wherein, when the position of the car is unable to be grasped and the arrival of the car at the terminal floor is detected after detection of a first storage medium and before detection of a second storage medium, the safety monitor measures a distance from a detection position of the first storage medium to the detection position of the terminal floor car detector based on the signal from the movement detector, compares the measured distance with the stored information, and determines a position of the car at the detection position of the terminal floor car detector in accordance with a result of the comparison.

4. The elevator apparatus according to claim 1, further comprising:

a plurality of members to be detected, which are arranged in the hoistway so as to be spaced from one another in the hoisting direction of the car; and a position sensor mounted to the car, that detects the plurality of members to be detected, wherein the safety monitor is configured to: execute an operation for detecting the member to be detected in addition to the two of the plurality of storage media; and to grasp the position of the car by also using position information of the member to be detected, when the position of the car is unable to be grasped.

5. The elevator apparatus according to claim 4, further comprising terminal floor car detector that detects arrival of the car at a terminal floor, wherein operation modes of the safety monitor include a learning operation mode, and wherein, in the learning operation mode, the safety monitor is configured to measure a distance from a detection position of the terminal floor car detector to a detection position of the storage medium and a distance from the detection position of the terminal floor car detector to a detection position of the member to be detected based on the signal from the movement detector; and to store the distance from the detection position of the terminal floor car detector to the detection position of the storage medium, the intervals of the plurality of storage media, and the distance from the detection position of the terminal floor car detector to the detection position of the member to be detected.

6. An elevator apparatus, comprising:

a car;

movement detector that generates a signal in accordance with movement of the car;

a plurality of storage media arranged in a hoistway so as to be spaced from one another in a hoisting direction of the car;

reading device mounted to the car, that reads individual identification information stored in the plurality of storage media;

a plurality of members to be detected, which are arranged in the hoistway so as to be spaced from one another in the hoisting direction of the car;

a position sensor mounted to the car, that detects the plurality of members to be detected; and a safety monitor that detects a moving amount and a position of the car by using the signal from the movement detector and monitoring presence or absence of abnormality in an operation state of the car, wherein the safety monitor is configured to: store a distance from a detection position of the storage medium to a detection position of the member to be detected adjacent thereto and position information of the plurality of members to be detected, and wherein the safety monitor is configured to: execute an operation for detecting the storage medium and the member to be detected; measure a distance from the detection position of the storage medium to the detection position of the member to be detected based on the signal from the movement detector; compare the measured distance with the stored information; and to grasp the position of the car by using a result of the comparison, the individual identification information of the plurality of storage media, and the position information of the plurality of members to be detected, when the position of the car is unable to be grasped.

7. The elevator apparatus according to claim 6, further comprising terminal floor car detector that detects arrival of the car at a terminal floor, wherein operation modes of the safety monitor include a learning operation mode, and wherein, in the learning operation mode, the safety monitor is configured to: measure a distance from a detection position of the terminal floor car detector to a detection position of the storage medium and a distance from the detection position of the terminal floor car detector to a detection position of the member to be detected based on the signal from the movement detector; and to store the distance from the detection position of the terminal floor car detector to the storage medium, the intervals of the plurality of storage media, the distance from the detection position of the terminal floor car detector to the detection position of the member to be detected, and a distance from the detection position of the storage medium to a detection position of the member to be detected adjacent thereto.

8. The elevator apparatus according to claim 7, wherein, when the position of the car is unable to be grasped and the arrival of the car at the terminal floor is detected after detection of the storage medium and before detection of the member to be detected, the safety monitor measures a distance from a detection position of the storage medium to the detection position of the terminal floor car detector based on the signal from the movement detector, compares the measured distance with the stored information, and determines a position of the car at the detection position of the terminal floor car detector in accordance with a result of the comparison.

9. The elevator apparatus according to claim 4, wherein the plurality of members to be detected each comprise a landing plate, and the position sensor comprises a landing sensor.

10. The elevator apparatus according to claim 1, wherein, when the position of the car is grasped, the safety monitor monitors presence or absence of overspeed traveling of the car based on a first overspeed monitoring reference that becomes continuously lower in a terminal direction near a terminal floor of the hoistway, and wherein, when the position of the car is unable to be grasped and a failure of equipment used for grasping the position of the car is detected by an operation for grasping the position of the car, the safety monitor limits a traveling speed of the car to a speed lower than a normal traveling speed, and monitors the presence or absence of the overspeed traveling of the car based on a second overspeed monitoring reference of a fixed level that is lower than the first overspeed monitoring reference.

11. The elevator apparatus according to claim 1, wherein the movement detector comprises a rotary encoder, wherein each of the plurality of storage media is capable of wireless communication, wherein the reading device comprises a reader that reads the individual identification information of the plurality of storage media in a noncontact manner, and wherein the safety monitor is configured to store information associating the individual identification information with a position in the hoistway.

12. The elevator apparatus according to claim 6, wherein the plurality of members to be detected each comprise a landing plate, and the position sensor comprises a landing sensor.

13. The elevator apparatus according to claim 6, wherein, when the position of the car is grasped, the safety monitor monitors presence or absence of overspeed traveling of the car based on a first overspeed monitoring reference that becomes continuously lower in a terminal direction near a terminal floor of the hoistway, and wherein, when the position of the car is unable to be grasped and a failure of equipment used for grasping the position of the car is detected by an operation for grasping the position of the car, the safety monitor limits a traveling speed of the car to a speed lower than a normal traveling speed, and monitors the presence or absence of the overspeed traveling of the car based on a second overspeed monitoring reference of a fixed level that is lower than the first overspeed monitoring reference.

14. The elevator apparatus according to claim 6, wherein the movement detector comprises a rotary encoder, wherein each of the plurality of storage media is capable of wireless communication, wherein the reading device comprises a reader that reads the individual identification information of the plurality of storage media in a noncontact manner, and wherein the safety monitor is configured to store information associating the individual identification information with a position in the hoistway.

* * * * *